US007854634B2

(12) United States Patent
Filipon et al.

(10) Patent No.: US 7,854,634 B2
(45) Date of Patent: Dec. 21, 2010

(54) JACK CONNECTOR ASSEMBLY HAVING CIRCUITRY COMPONENTS INTEGRATED FOR PROVIDING POE-FUNCTIONALITY

(75) Inventors: Sven Filipon, Heilbronn (DE); Wolfgang Herrmann, Munich (DE); Stephan Steinke, Brackenheim (DE); Michael Hartmann, Neudenau (DE)

(73) Assignee: Molex Incorporated, Lisle, IL (US)

( * ) Notice: Subject to any disclaimer, the term of this patent is extended or adjusted under 35 U.S.C. 154(b) by 327 days.

(21) Appl. No.: 11/570,963

(22) PCT Filed: Mar. 11, 2005

(86) PCT No.: PCT/EP2005/002586

§ 371 (c)(1),
(2), (4) Date: Apr. 3, 2009

(87) PCT Pub. No.: WO2006/000261

PCT Pub. Date: Jan. 5, 2006

(65) Prior Publication Data

US 2009/0298349 A1 Dec. 3, 2009

(30) Foreign Application Priority Data

Jun. 24, 2004 (WO) ..... PCT/EP2004/006824

(51) Int. Cl.
*H01R 24/00* (2006.01)

(52) U.S. Cl. ..... 439/676

(58) Field of Classification Search ..... 439/669, 439/676, 572, 701, 487, 607.01, 607.43
See application file for complete search history.

(56) References Cited

U.S. PATENT DOCUMENTS

| | | | | |
|---|---|---|---|---|
| 4,454,596 | A * | 6/1984 | Wunsch et al. | 361/679.21 |
| 5,387,135 | A * | 2/1995 | Shen et al. | 439/676 |
| 6,381,283 | B1 | 4/2002 | Bhardwaj et al. | |
| 2002/0090862 | A1 | 7/2002 | Berstein et al. | |
| 2003/0194908 | A1 | 10/2003 | Brown et al. | |
| 2003/0194912 | A1 | 10/2003 | Ferentz | |
| 2004/0073597 | A1 | 4/2004 | Caveney et al. | |

* cited by examiner

*Primary Examiner*—Chandrika Prasad
(74) *Attorney, Agent, or Firm*—Stephen L. Sheldon

(57) ABSTRACT

The invention relates to a jack connector assembly having circuitry components integrated providing power over LAN-functionality, in particular for use with regard to Ethernet-networks. An object of the present invention is to provide a jack connector assembly providing integrated power over LAN-functionality and especially avoiding any undesirable and destructive heat accumulation. The object is achieved by a modular jack connector assembly having at least one connector housing (100) and at least one connector insert (200) insertable into the connector housing, each connector housing (100) having a front mating side with at least one port opening (301, 312) for receiving a plug having a plurality of electrical contacts and a rear side (112) for inserting at least one of said connector inserts (200), each connector insert (200) having a front end side and a rear end side and is supporting electrical contacts (240) with contact sections (245, 246) arranged at the front end for detachable connection with corresponding electrical contacts of at least one of said plugs, and is supporting at the rear end side components (260) of a circuitry providing a power over LAN-functionality.

26 Claims, 9 Drawing Sheets

JACK CONNECTOR ASSEMBLY HAVING CIRCUITRY COMPONENTS INTEGRATED FOR PROVIDING POE-FUNCTIONALITY

This is a National Phase application of PCT/EP2005/002586 filed on Mar. 11, 2005, which claims the benefit of priority of PCT/EP2004/006824, filed Jun. 24, 2004.

The invention relates to a jack connector assembly having circuitry components integrated providing power over LAN-functionality, in particular for use with regard to Ethernet-networks.

BACKGROUND AND STATE OF THE ART

Usually, a jack connector assembly provides within an common outer housing a given amount of ports in an arrangement stacked on top of each other and/or in a side-by-side relationship. For defining the ports the type of which correspond for example with an RJ-45, RJ-11, RJ-21 and/or may be used for example in local area network (LAN), the connector housing comprises a mating side with respective plug receiving openings. Electrical contacts are supported by at least an insert insertable into the housing and arranged within the plug receiving openings for providing detachable connection with at least one plug received.

Typical local area networks for example may be telephone switching networks, computer networks and/or networks for automation using a plurality of data transmitting means including coaxial cables, optical fibres and/or telephone cables. Such topographies of local area networks are known for example as Ethernet-networks and are subject of a plurality of electrical standards as for example IEEE 802.3. The Ethernets-networks usually have to provide a huge amount of shared and/or distributed connections. Since such networks are operated at rates of about 1 Gigabit and more there is a need for a significant conditioning of the signals to be transferred. Accordingly, a metal outer shield encapsulating the connector housing usually is needed for providing for example a common mode rejection (CMR) and a pre-given electromagnetic compatibility (EMC) or electromagnetic interference (EMI) immunity. For the conditioning of the signals usually corresponding components such as for example coils or capacitive elements have to be arranged within the assembly, too.

Due to the demand of an ever increasing miniaturisation in providing a plurality of different connections there is a need with regard to the manufacturing of space-saving jack connector assemblies.

Moreover, there is the demand of providing a power over LAN functionality and hence, with regard to Ethernet compatible networks a power over Ethernet (POE) functionality. As known, such POE or "active Ethernet" additionally may eliminate the need to run 110/220 VAC power to wireless access points and other devices on a wired LAN.

Until today however, most of the components necessary for ensuring power of LAN as well as respective jack connector assemblies used within such LANs are provided independently from each other and the functional integration and/or combination thereof is made on the premises only. Moreover, each customer or provider of a LAN such as an Ethernet usually has its own specific designs and constructions, such as a PCB-design with regard to the wiring/routing layouts and the components which have to be incorporated within the concept of a connector assembly providing power over LAN. Accordingly, the today's concepts involve a lot of space and a plurality of undue components as an early functional combination or splitting of tasks and/or purpose in principle is impossible. This however, would result in saving components.

Thus, there is the need for an integration within a jack connector assembly of circuitry components enabling power over LAN, especially enabling POE.

US-document 2003/0194912 A1 is describing an active area network connector for use in a local area network including at least one LAN node, the active connector comprising at least one active connector housing, at least one first plurality of first electrical contacts mounted in said housing and arranged for detachable connection with corresponding electrical contacts of at least one plug, at least one second plurality of second electrical contacts mounted in that housing and arranged for connection with corresponding electrical contacts of local area network equipment, and active power control circuitry located within said housing and coupled to at least some of said first and second electrical contacts, said active power control circuitry being operative for controlling the supply of electrical power over said local area network cabling to at least one node of the local area network.

A main disadvantage of such an connector assembly is however, that the heat produced by such an integrated power control circuitry accumulates inside the housing and hence is causing misoperations up to a total breakdown of the entire connector assembly and hence, will result in that other parts of the network including other components coupled with the network will failure, too.

SUMMARY OF THE INVENTION

An object of the present invention is therefore to provide a jack connector assembly providing integrated power over LAN functionality and overcoming at least some of the major problems involved with the state of the art.

The object is achieved by a subject matter having the features according to any of the attached independent claims. Advantageous and/or preferred embodiment or refinements are the subject matter of the dependent claims.

Accordingly the invention suggests, especially for avoiding any undesirable and destructive heat accumulation, a modular jack connector assembly having at least one connector housing and at least one connector insert insertable into the connector housing, wherein each connector housing having a front mating side with at least one port opening for receiving a plug having a plurality of electrical contacts and a rear side for inserting at least one of said connector inserts, wherein each connector insert having a front end and a rear end and is supporting electrical contacts with contact sections arranged at the front end for detachable connection with corresponding electrical contacts of at least one of said plugs, and is supporting at the rear end side components of a circuitry providing a power over LAN-functionality, that components are arranged outside the jack connector housing.

Thus, a very improved active connector assembly for use in a local area network including at least one LAN node is provided, wherein active power control circuitry components located outside said at least one connector housing can be coupled to at least some of said plurality of electrical contacts mounted in said housing and arranged for detachable connection with corresponding electrical contacts of at least one plug insertable into a respective port opening provided by the housing and to at least some of a plurality of second electrical contacts arranged for connection with corresponding electrical contact of local area network equipment, with said active power control circuitry components being operative for controlling the supply of electrical power over said local area network cabling to at least one node of the local area network and without the risk of a dangerous heat accumulation since any heat produced by the operating circuitry components can unhamperedly dissipate to outside airflow.

With regard to a further specific object of providing a way of controlling an amount of jack connector assemblies each of which providing integrated power over LAN functionality by means of reduced data transmitting components, the invention proposes as an alternative or additional solution a modular jack connector assembly having at least one connector housing and at least one connector insert insertable into the connector housing, wherein each connector housing having a front mating side with at least one port opening for receiving a plug having a plurality of electrical contacts and a rear-side for inserting at least one of said connector inserts. Each connector insert has a front-end and a rear-end and is supporting electrical contacts with contact sections arranged at the front-end for detachable connection with corresponding electrical contacts of at least one of said plugs and is supporting components of a circuitry providing a power over LAN-functionality. Addressing means being incorporated within the inventive connector assembly for providing a power over LAN-functionality for at least some of the ports individually and selectively, preferably via a common $I^2C$ bus.

As a consequence, by providing the possibility of selectively addressing power over LAN-functionality for individual ports in many application environments having a plurality of jack connector assemblies each of which providing integrated power over LAN functionality the need of communication lines or wires can be reduced efficiently, as a common bus, especially a common $I^2C$ bus, is usable for operating several jack connector assemblies.

According to a preferred embodiment, said circuitry components for providing a power over LAN-functionality are mounted to a backplane board connected to the rear end side of at least one support insert, with said backplane board and the at least one support insert forming the at least one insert which is received by at least one connector housing with the front end side of the at least one support insert first and with at least said circuitry components being arranged outside.

It is further proposed that at least some of the circuitry components are mounted at a backplane board surface defining an exterior rear surface side of the insert and are sandwiched layered between said exterior surface and components suitable for heat dissipation.

According to the very preferred embodiments, said at least some circuitry components includes at least one IC-chip for impressing the voltage providing the Power over LAN functionality to the medium.

To further increase the thermal conductivity and to reduce the thermal transition resistance said components suitable for heat dissipation are fixed close each other by mounting means provided at the backplane board.

According to an embodiment, said components suitable for heat dissipation include a heat conductor covering said least some circuitry components and a heat sink. The heat conductor may be build up for example in kind of a plate, of a foil or of a gap filler, such as foam or an elastic material like a silicone based material. Moreover, for ensuring a high voltage electrical isolation, the heat conductor may be in principle of any kind of heat conducting material or compound having an electrically isolating effect.

According to a very preferred embodiment, the connector assembly includes an outer common metal shield encapsulating the housing and the insert with the circuitry components, a rear part of the common shield being used as one of said components suitable for heat dissipation. Thus, even by shielding the entire assembly, any heat can be easily transferred to an outside airflow.

It is further proposed according to a refinement, that each support insert includes two support boards spaced apart from each other and defining together with said backplane board exterior side and rear surfaces of a respective insert, so that a plurality of different conditioning components can be modularly combined with such an subassembly, in particular by means of compatible box like modules such as for example solenoid boxes comprising a plurality of hubs.

It is further advantageous, if each support board and the backplane board is provided with a wiring and/or routing circuit to easily enable a variety of individual electrical connections.

Preferably, each support board and the backplane board (251) include respectively complementary formed mounting means.

In this regard is further proposed, that each support board includes at its rear end side at least one tap overlapping with a respectively complementary formed recess soldered together, thereby providing at least one electrical connection, preferably thereby simultaneously providing for each port a power over LAN connection.

For the visual indication of connection integrities LEDs, preferably SMT-LEDs, can be easily mounted at the support inserts and arranged to emit light in direction to the port openings.

According to a very preferred embodiment, for each port four LEDs are provided and electrically connected by means of a ground board of the assembly, with the ground board having a definable routing layout.

According to a further refinement, a power connector is integrated with the assembly by an electrical and mechanical connection with the backplane board for receiving a power supply via an insertable power connector plug.

In addition or as an alternative, it is proposed that the power supply is provided over power pins electrically connected via a ground board having a definable routing layout.

According to a refinement, such a ground board is build up as a multi-layered board for ensuring a capacitor effect, in particular for providing an improved filtering of interfering signals.

According to a further preferred embodiment, the inventive connector is fitted with a ground board having a definable routing layout with particular pin arrays respectively adapted for providing and/or receiving terminal pins enabling individual functions. Preferably, such pin arrays are at least split in arrays enabling a power over LAN pin functionality, in a LED pin functionality, a LAN pin functionality. Moreover, the arrays additionally comprise at least one array providing a power supply pin functionality.

According to a further very preferred embodiment the addressing means including address pins being provided and/or received by a such ground board having a definable routing layout.

According to a further preferred refinement the addressing means are operable with one of at least two selectable modes, one of which operates the addressing pins according to an auto mode providing standardised functions without external control and one of which operates the addressing means based on a power management mode for controlling all functions selectively, preferably for each individual port externally by using said $I^2C$ bus.

As a further advantage by providing such a power management mode a plurality of advanced functionalities are available, such as legacy detection of none-standard port designs, of power management in particularly with regard to system and port levels, a plurality of fault detection functionalities for each port selectively, a controlled current ramp power-up/down for electromagnetic interference (EMI) reduction with the external addressing allowing the control of up to a plurality of inventive POE modules or connectors with a single bus.

The very preferred inventive entire connector assembly is being Ethernet compatible and hence, the at least one IC-chip is providing POE functionality.

An alternative very preferred inventive connector assembly is configured internally with respective one chip providing POE functionality for respective one port. This is further reducing the dimensions of each chip to be packaged and the complex inner structure of each chip.

According to a further preferred refinement a hipot (high potential) insulation is provided for the address pins and the bus, preferably by the use of optocoupler or an other suitable component of providing galvanic isolation, so there are in principal neither further need nor extra cost for adding suitable components at a customer board for such hipot requirements.

Further advantages and features will be apparently by the following description of the invention in more detail based on preferred embodiments taken in conjunction with the drawings in which:

DETAILED DESCRIPTION OF PREFERRED BUT EXEMPLAR EMBODIMENTS ACCORDING TO THE INVENTION

Figure 1:
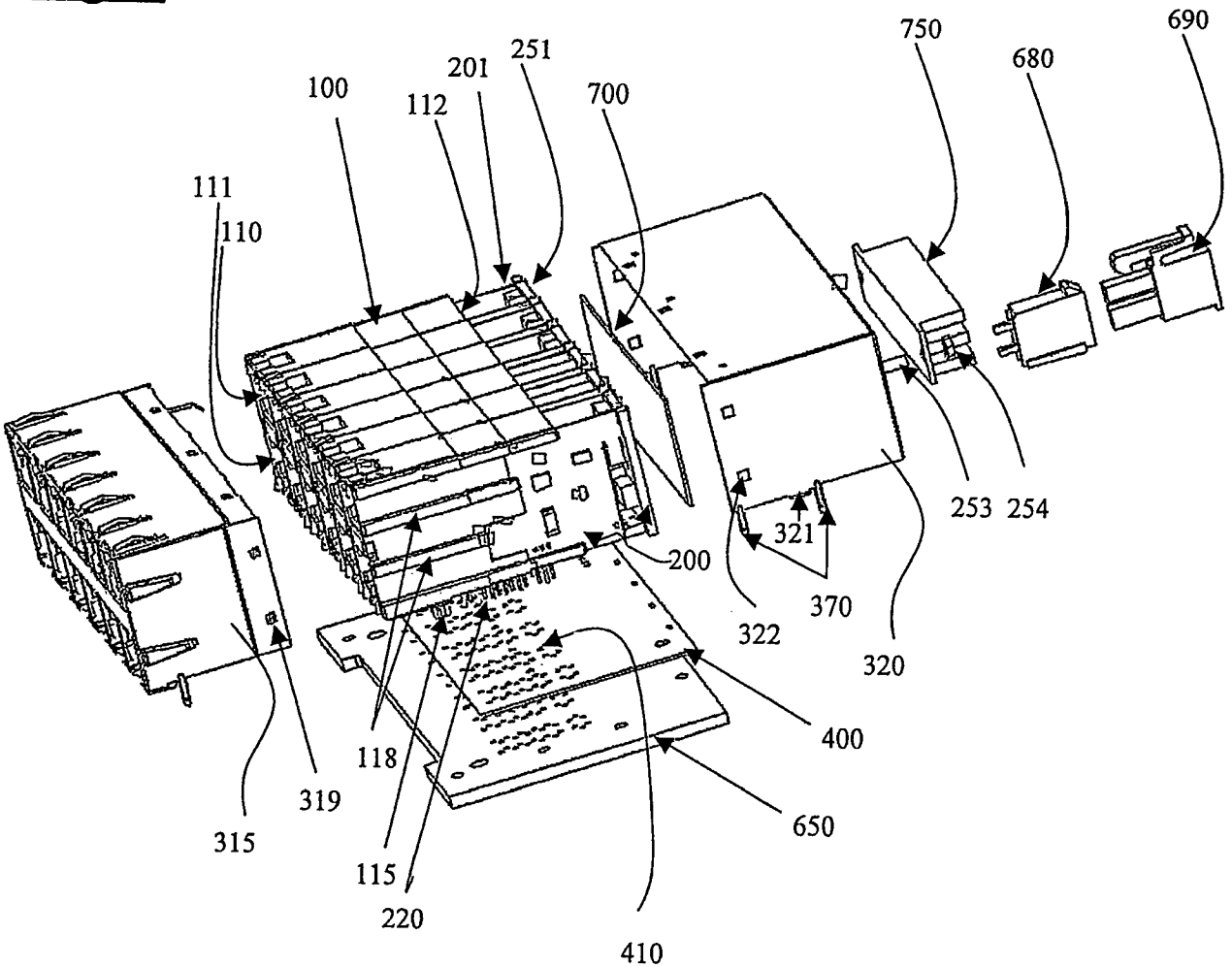
FIG. 1 is an exploded view of a jack connector assembly incorporating the inventively integrated electrical components for providing power over LAN functionality.
Figure 2:
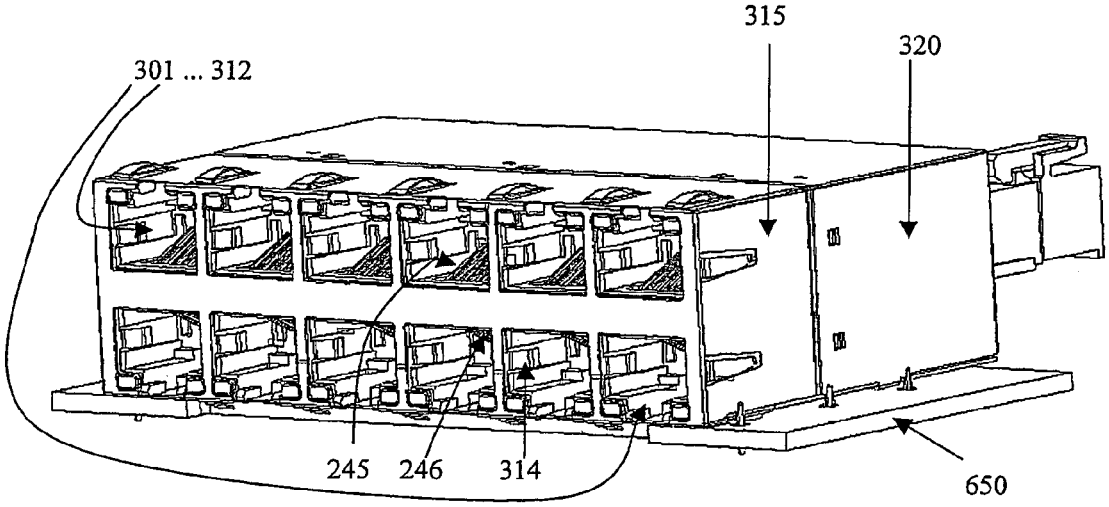
FIG. 2 is a perspective view of the inventive jack connector assembly of FIG. 1 in assembled condition.
Figure 3:
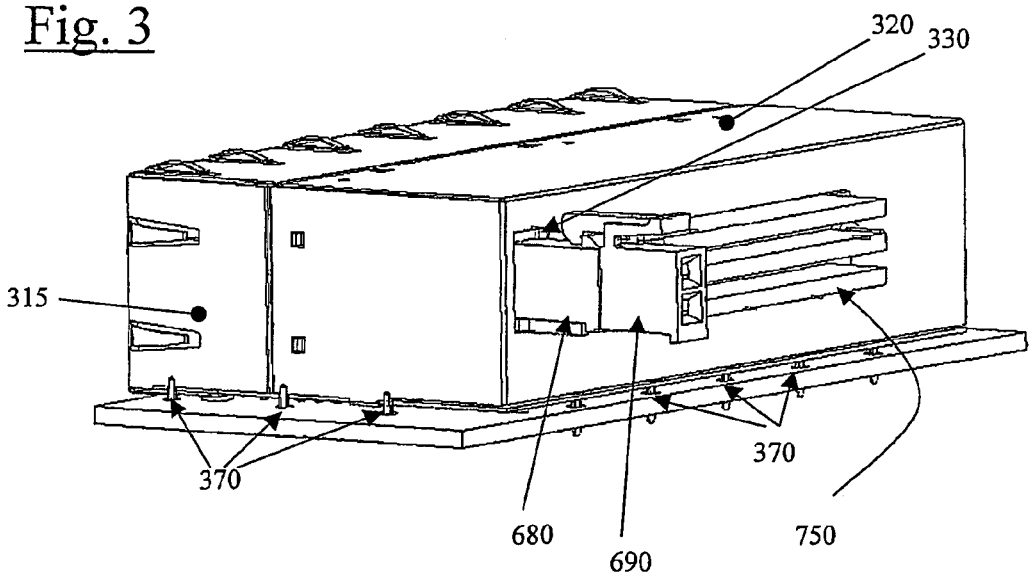
FIG. 3 is a further view of the assembled jack connector assembly of FIG. 2 but rather seen from the rear side than from the front side.

Regarding mainly FIG. 1 to 3 first, a preferred but exemplar embodiment of a modular jack connector assembly providing a plurality of plug receiving ports and including inventively integrated electrical components for providing power over LAN, in particular adapted for providing power over Ethernet (PoE) network is depicted. Accordingly, the ports correspond for example to an RJ-45 used in an Ethernet environment. FIG. 1 is a perspective view of the exploded condition and FIGS. 2 and 3 are perspective views of the assembled condition seen rather from the front side or from the rear side.

As can be seen, in particular in FIGS. 1 and 2 a plurality of six jack connector housings 100 made from a insulating material are mounted together in a side by side arrangement ship. For the side by side arrangement, preferably each jack connector housing 100 has complementary latch or mounting means, of which the mounting means of one jack connector housing 100 interacts with the mounting means of an adjacent jack connector housing 100. In addition, each jack connector housings 100 may be adapted, for example by means of guiding ribs (not shown) for the insertion of a respective vertical positioned metal shielding plate (not shown) between each of the side by side arranged jack connector housings 100. In case the connector housings 100 are made of isolating material as described, such metal shields may be inserted without the need of an additional isolation resulting in cost saving.

For providing the plug receiving ports in assembled condition, each jack connector housing 100 includes a front or mating side comprising respective two plug receiving openings 110, 111 stacked one upon each other. Furthermore, each jack connector housing 100 is adapted to support a jack connector subassembly or insert 200 having a support insert 201 with a backplane board 251 mounted therewith. The insert 200 is insertable into the jack connector housing 100 via a rear side 112 thereof opposite to the front or mating side.

Figure 7:
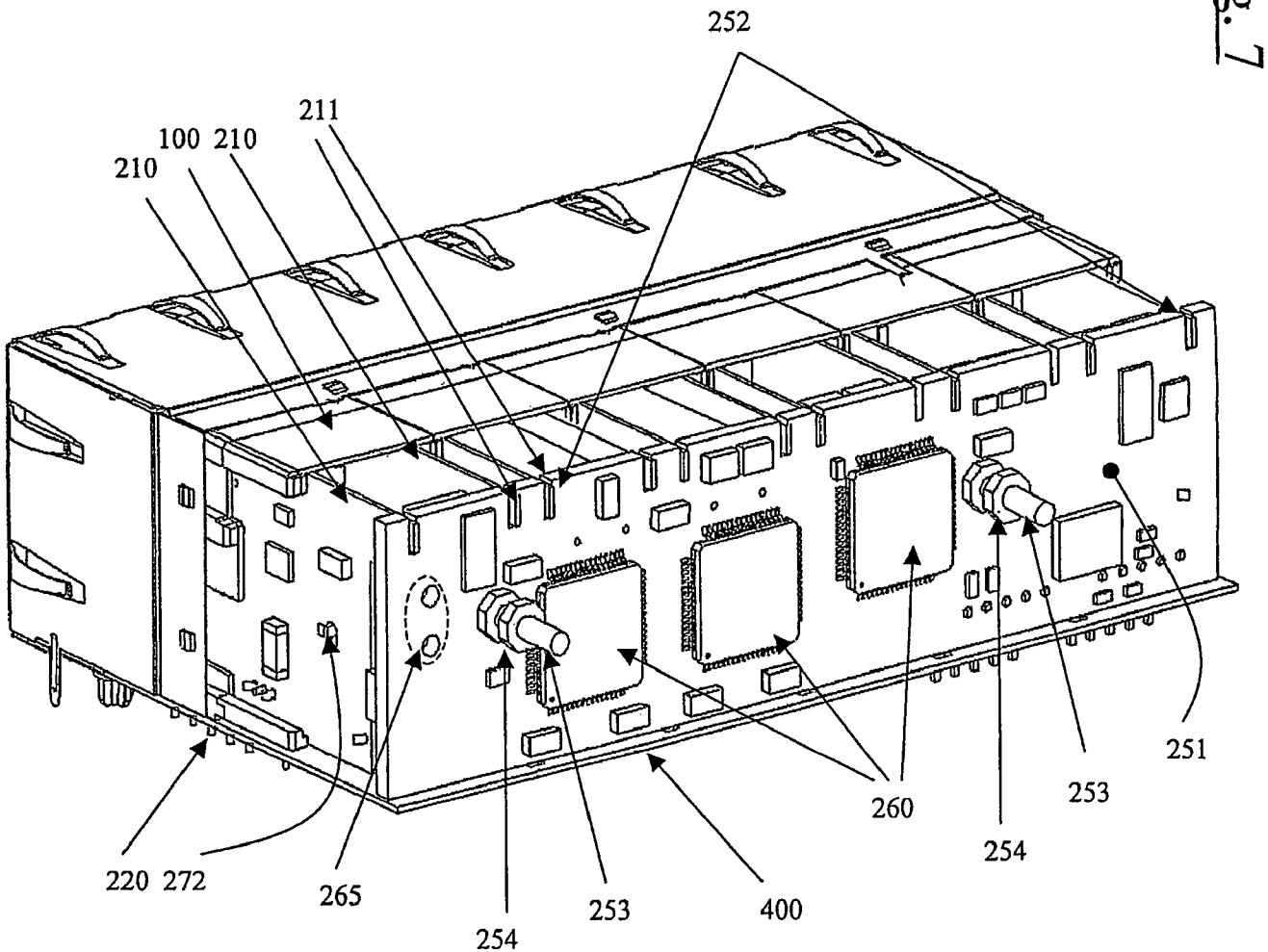
FIG. 7 is a perspective view from the rear side of the jack connector assembly and with the back plane PCB supporting integrated electrical components for providing power over LAN functionality exposed.
Figure 8:
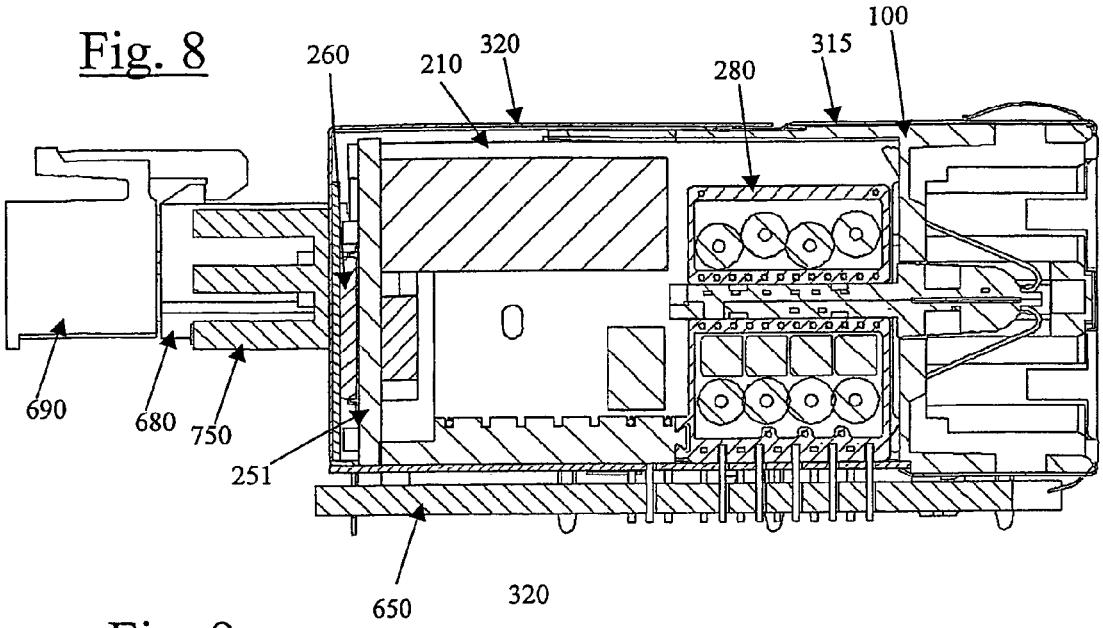
FIG. 8 is a longitudinal section view through the jack connector assembly of FIG. 1.
Figure 10:
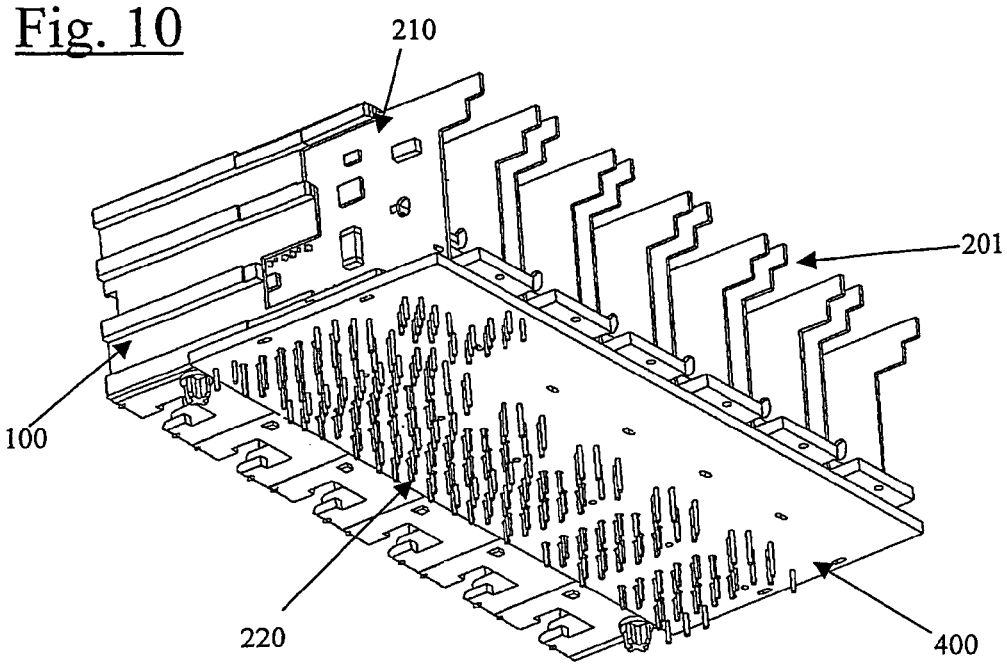
FIG. 10 is a view taken from the bottom of pre-assembled jack connector housings and support inserts showing a particular pin array arrangement of a grounding PCB and with the power supply ensured by means of power pins instead of a power cable.

As can be seen from FIG. 1, and in particular from FIGS. 7, 8 and 10 at a rear section of the support inserts 201 the backplane board 251 is mounted. At the backplane board 251 remote to the jack connector housings 100 the integrated electrical components for providing power over LAN functionality, in particular for providing the POE, are supported outside the jack connector housings 100 for preventing heat accumulation inside the connector housings 100 due to the integrated components, in particular due to integrated power chips or IC-chips 260.

Moreover, according to the preferred embodiment depicted, the backplane board 251 with the POE enabling components thereon is covered by a heat conductor plate 700 transferring the heat from the POE enabling components to a heatsink 750 arranged at the rear side of the assembled jack connector assembly and comprising electrically isolating material if necessary, in particular to provide isolation to ground and/or a hipot resistant effect.

It is mentioned however, that instead of the heat conductor plate 700 the heat conductor also may be build up in other structural shapes for example in kind of a foil or of a gap filler, for example by means of an elastic material or of foam. Materials having a good thermal conductivity and a electrically isolating effect are for example an elastomer based material preferably with an additional thermal conducting filler, such as silicone together with boron nitride or a ceramic powder, or a ceramic based material preferably with an additional thermal conducting paste thereon.

Furthermore as depicted, the arrangement of jack connector housings 100 with the inserted inserts 200 is preferably encapsulated by a common outer shield, preferably formed as a two part shield 315 and 320. For mounting the two parts, i.e. the front part 315 and the rear part 320 of the outer common shield together, each of the parts is provided with an overlapping area having projection sections 319 or complimentary cut-out sections 322 for fixing and soldering the front part 315 and the rear part 320 together.

Thus, according to the preferred embodiment depicted, the electrically isolating heat conductor plate 700 is embedded between the backplane board 251 thereby covering the POE enabling and controlling components and the rear part 320 of the shield to both transfer the heat from the POE circuitry components to the rear shield piece 320 and electrically isolate the POE circuitry components to the rear shield piece 320. As a result, in addition the to shielding function of the rear shield piece 320 it improves the mechanical fixing of the heat conducting plate 700 and can be used as a further heat conducting element, in particular to transfer the heat between the heat conductor plate 700 and the heatsink 750 dissipating the heat from the inside of the entire jack connector assembly to outside airflow.

As an alternative the rear shield piece 320 is provided with a cut-out area such that the heatsink 750 is directly contacting the heat conductor plate 700.

Moreover, for supplying the power to the integrated power chips 260 for enabling the POE functionality, such as a 48V/15.4 W power supply per port for complying with the IEEE 802.3af standard, a power connector 680 electrically connected to the power chips 260 is mechanically held by the rearward backplane board 251 and hence, is integrated with the entire jack connector assembly for receiving a corresponding power supplying connector plug side 690. The rear side of the rear part 320 of the shield and/or of the conductor plate 700 has cut-outs 330 for mounting the power connector 680 to the backplane board 251 and/or for passing mounting means 253 of the backplane board 251 for fixing heatsink 750.

Such mounting means 253 and preferably the complementary mounting means 254 securing the heatsink 705 to the mounting means 253 are preferably made of a plastic material to provide further increased hipot-isolation.

For assisting the assembling of the jack connector assembly, each respective outer jack connector housing 100 terminating the side by side arrangement further includes mounting rips 118, to provide an easy insertion of the arrangement of jack connector housings 100 into the common outer metal shield 315, 320 and to ensure a mechanical fixing therein. Preferably, at least the outer jack connector housings 100 includes fastening means 115, to fix the entire jack connector assembly on a support means, such as on the depicted board 650 which is for example, the jack connector assembly mounting board of a customer, in particular of the provider of a LAN, in particular of an Ethernet compatible network.

Due to the modular side by side arrangement of the individual jack connector housings 100 a variety of variations is enabled with regard to the amount of plug receiving ports with a single jack connector assembly and in principal, merely the outer shield 315, 320 has to be adapted based on the amount of jack connector housings 100 to be encapsulated. Correspondingly, based on the exemplary depicted embodiment the front part 315 of the outer shield comprises twelve recesses 301 and 312, so that twelve plug receiving ports are provided in assembled condition, as can be seen in particular from FIG. 2. With each of the recesses 301 and 312 shielding taps 314 are formed for the insertable plugs, with the taps 314 being pre-stressed and inwardly bent.

The inventive jack connector assembly according to the depicted embodiment is additional including a ground plate or board 400, preferably a printed circuit board (PCB), onto which the jack connector housings 100 are positioned such, that a plurality of pins 220 extending from the inserts 200 can pass through and/or routed via holes 410 of the plate 400, the holes 410 are arranged and adapted according to a customized pin and/or electrical circuitry layout, as exemplary described below. An additional mechanical positioning of the jack connector assembly is ensured thereby, too. Usefully, the ground board 400 is build up as a compensating board having a multi-layered body resulting in a capacitor effect for providing an enhanced interference suppression.

In assembled condition of the jack assembly, the outer shield 315, 320 preferably is soldered to the board 400, for example by means of solder taps 321 linked to the outer shield 315, 320. Accordingly, the ground board 400 is providing an additional shielding component, with the holes 410 apart from signal conductors or printed circuits isolated to the surrounding.

Moreover, connecting or solder extensions 370 are provided with the outer shield 315, 320 for providing a similar functionality with regard to the board 650.

Figure 4:
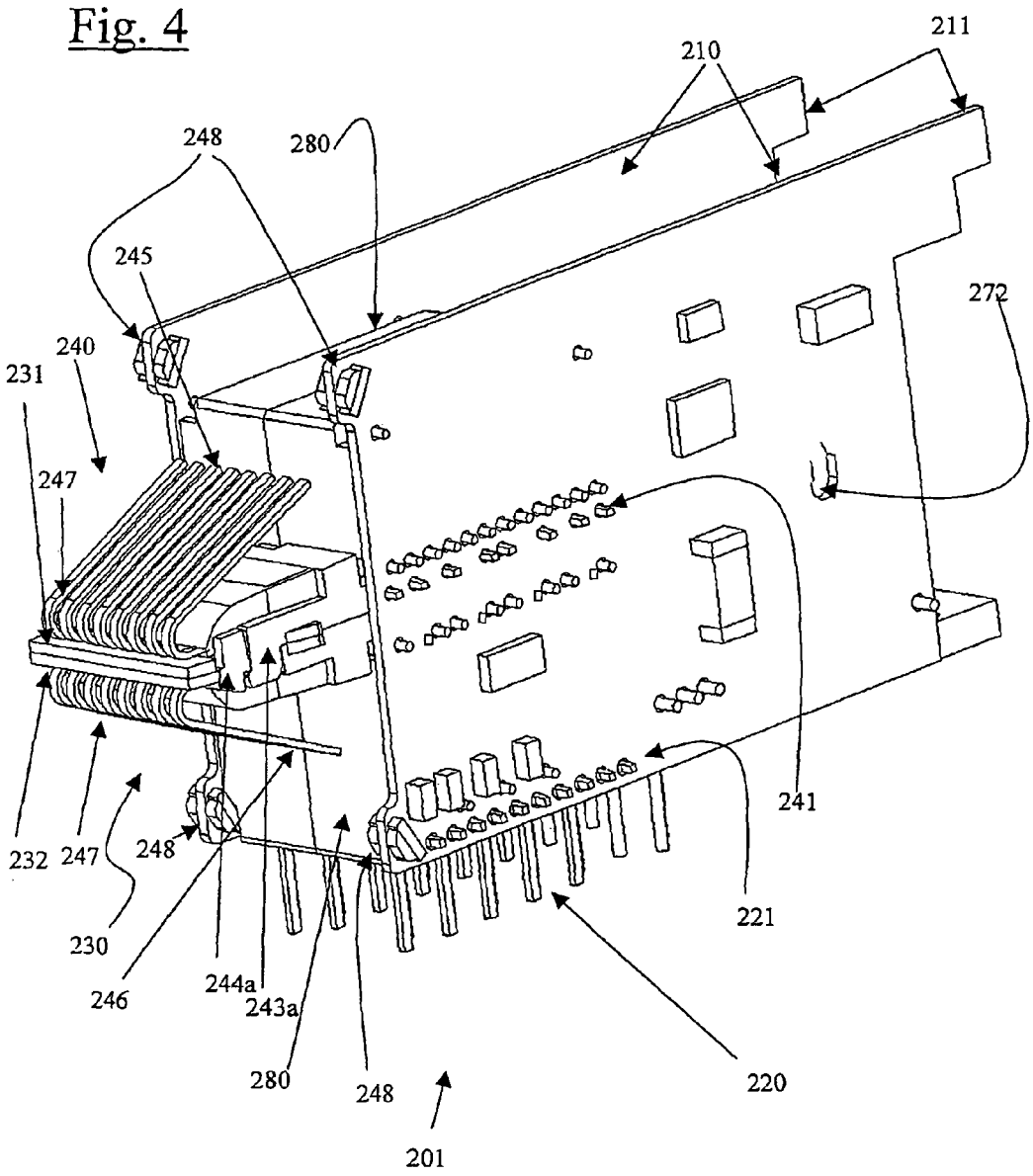
FIG. 4 is a perspective view of an exemplar connector subassembly or support insert of the jack connector assembly of FIG. 1.
Figure 5:
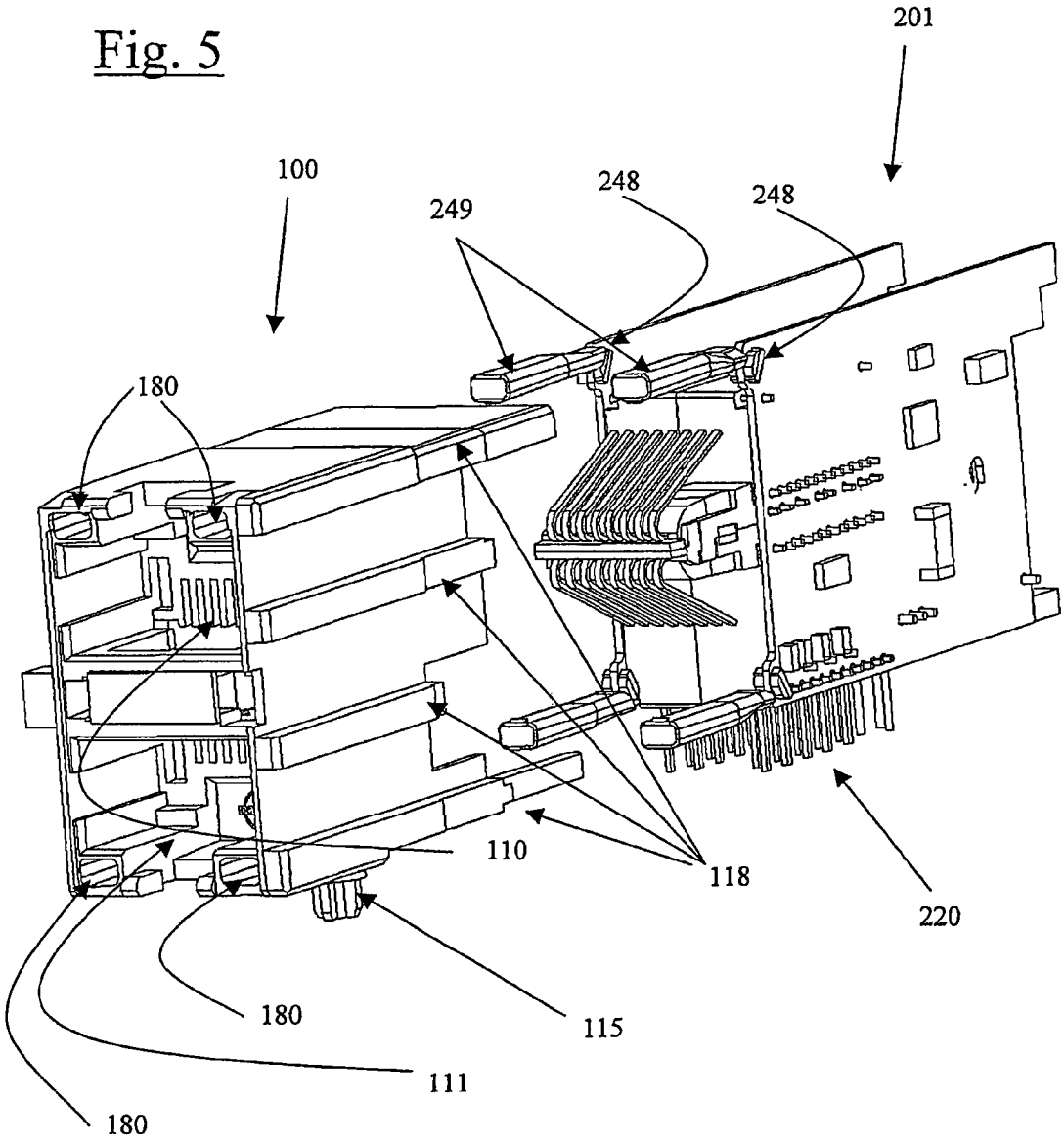
FIG. 5 is a perspective view of a jack connector housing and a support insert prior to its insertion into the jack connector housing.
Figure 6:
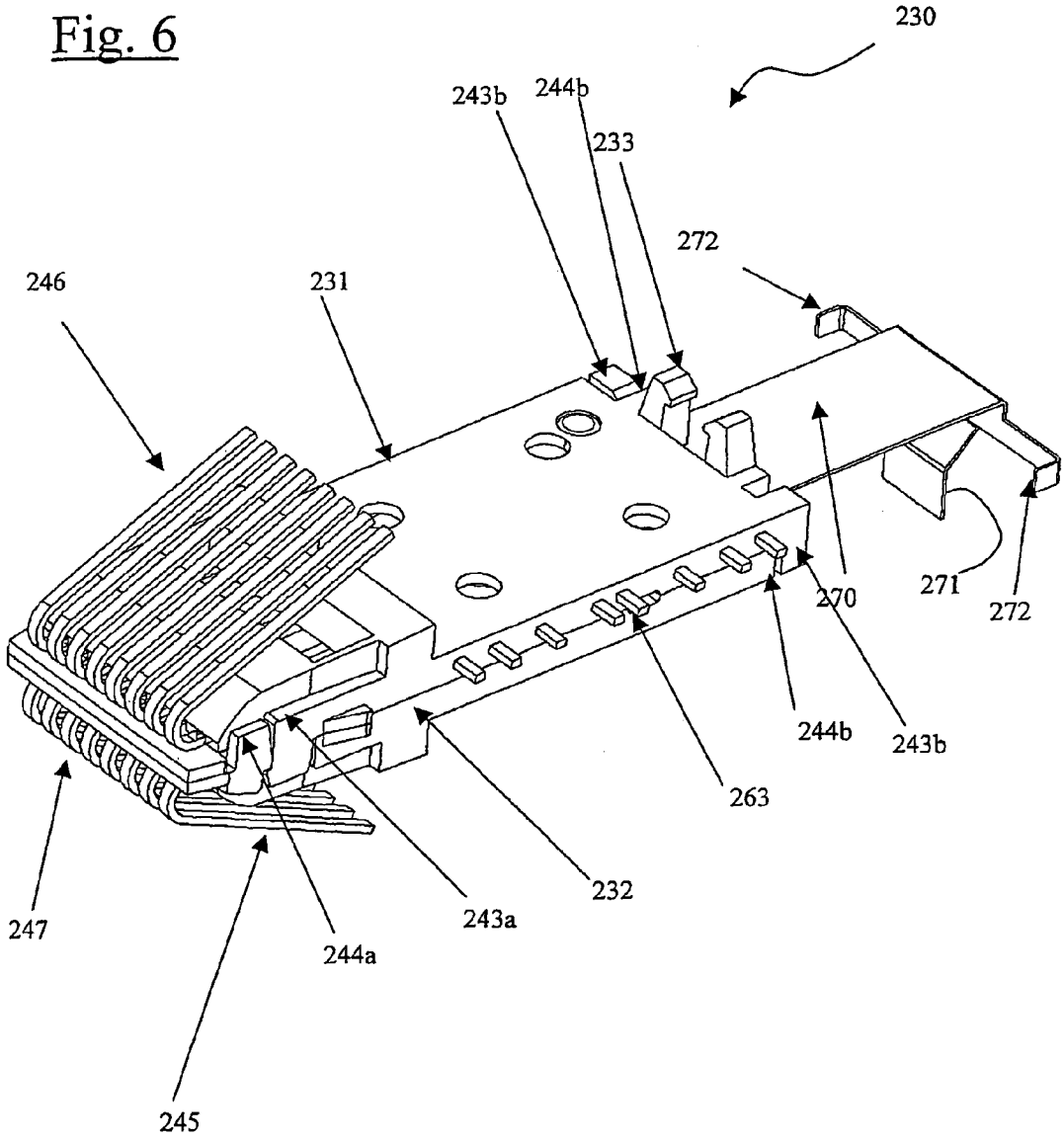
FIG. 6 is a perspective view of a chicklett supported by the support insert.

Regarding FIGS. 4 to 6, specific details or features of a respective jack connector support insert 201 are described.

As can be seen from FIG. 4, the support insert 201 comprises two support plates or board 210 parallel to and spaced apart from each other with circuit or conductor paths (not shown) for the electrical routing of power and particular signals and/or for the electrical connection of particular signal conditioning components.

Between the two mounting boards 210 and perpendicular to the planes defined by these mounting boards 210 a flat chicklett 230 is extending. The chicklett 230 is of insulating material and is supporting two rows of electrical contacts 240, each of which has socket contact sections 245 and 246 for protruding into the plug receiving openings 110, 111 of a jack connector housing 100 and arranged for detachable connection with corresponding electrical contacts of a plug inserted into the plug receiving openings 110, 111 of a jack connector housings 100.

Above and below the chicklett 230 a head space is defined within which box-like modules 280 are insertable, especially box-like solenoids to rectify signals. The solenoids may be pre-assembled and may comprise 2, 4, 8 or 12 hubs.

A plurality of individual wired electric/electronic components are arranged at the inside and outside surfaces of the support boards 210.

A plurality of the afore mentioned pins 220 protruding out of the support insert 201 is formed like a right-angle and is extending from a short pin-end 221 which is joint with a terminating hole of a support board 210 for the electrical connection therewith.

Preferably, the chicklett 230 is being made up of two identical chicklett halves 231 and 232 between which a metal shielding plate 270 is sandwich-like embedded. Each chicklett half 231 and 232 has at two opposite sides thereof respective two complementary snap means 243*a*, 244*a* and 243*b*, 244*b* for detachable fixing the halves 231 and 232 easily by mounting one upon the other. Respective one rows of electrical contacts 240 is embedded within one chicklett half 231 and 232 by over-moulding. Rearward ends 241 of the electrical contacts 240 protrude laterally out of each chicklett half 231 and 232 for the reception by a terminating hole of a respective support board 210. The socket contact sections 245 and 246 are exposed, cantilevered and bent back at an area 247 defining a radius. Hence, in fully assembled condition, the socket contact sections 245 are arranged within the upper opening 110 of a jack connector housing and the socket contact sections 246 are arranged within the lower opening 111 of a jack connector housing (FIG. 2).

The chicklett halves 231 and 232 further includes mounting means 233 for mounting the box-like modules 280. Due to the over-moulded contacts 240 an additional isolation for the metal shielding plate 270 is avoided. The shielding plate 270 includes a rearward solder area 271 which may be joint for example with the outer rear shield piece 320 to minimize any transition resistance for further improving EMC- and/or CMR-coefficients and to provide near END and crosstalk attenuation. For the connection with the support boards 210 the shielding plate 270 is includes two laterally bent taps 272.

Furthermore, at the rear sides of the support boards 210 two taps 211 are formed at an upper end area. The taps 211 are suitable for mechanically fixing the backplane board 251 at the support insert(s) 201 to build the whole insert 200. Correspondingly, the backplane board 251 is provided with recesses 251 (FIG. 7) into which the taps 211 are inserted. Moreover, preferably in case the power supply is provided by an additional power connector 680 (FIGS. 1 to 3) fixed at the backplane board 251, for the particular function of providing electrical POE connections and hence, also to provide each port with power of +48V and 48V Return to enable an Inline power supply for each port, at each of the opposite surfaces of each tap 211 respective solder pads are soldered together. It is mentioned however, in particular in case a power supply is not provided by an additional power connector 680 via the backplane board 251 the function of the ground board 400 can be increased in that particular power pins 220 extend between such a ground board 400 and the insert 200 and hence, to provide each port with power of +48V, too.

As an alternative, it is mentioned, that only the support boards 210 may have instead of taps 211 recesses overlapping with the backplane board 251.

Preferably, the support inserts 201 are equipped additionally with an LED-functionality, especially for the visual indication of circuit integrities. At each support board 210, as depicted on FIGS. 4 and 5, up to four LEDs 248, in particular SMT (surface mount technology)-LEDs emitting light in a right-angle, may be mounted and preferably electrically connected by means of a customized routing layout of respective LED pins 220 (FIGS. 10, 11) via the ground board 400. Accordingly, at the front side of each support board 210, i.e. the side with which the insert 200 is inserted into a jack connector housing 100, respective one LED 248 is mounted at a top and a bottom area of each inner and outer surface of the support board 210.

With such an arrangement, in principle each kind of colour and each kind of electric circuit technique may be realized. Based on a common anode or common cathode, for example, three LED pins are needed for two LEDs 248 or based on cross-connected LEDS 248 two LED pins are needed for two LEDs 248.

The light emitted at right angles with regard to the mounting surface of SMT-LEDS 248 may be easily directed to the ports through light pipes 249 which are mounted to the support board 210 and preferably accommodated within guide ways 180 of the jack connector housings 100 (FIG. 5).

Figure 9:
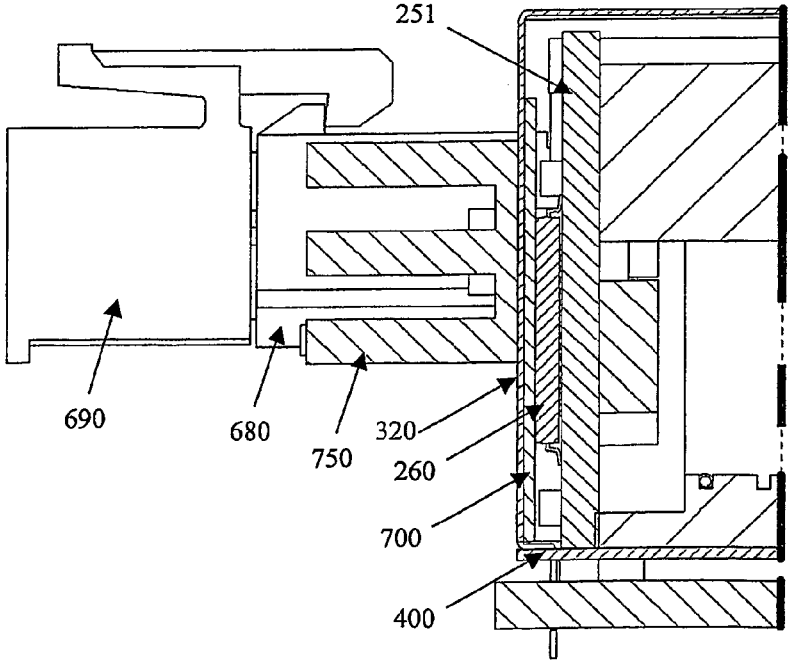
FIG. 9 is a more detailed sectional view of FIG. 8 concerning a very preferred arrangement for heat dissipation.

Regarding mainly FIGS. 7, 8 and 9, a preferred arrangement concerning the backplane board 251 supporting electronic components for providing POE functionality and the effective heat dissipation combination according to the invention is depicted.

Based on FIG. 7, the rear part of the outer common shield is removed and hence, a backplane board 251 forming part of a plurality of inserts 200 is exposed for a better understanding. Using one single backplane board 251 as a part of a plurality of inserts 200 facilitates the circuit layout and improves the mechanical support as well as the packing density of the backplane board 251. However, it is mentioned, that even respective one single backplane board may be mounted with the support boards 210 of respective one support insert 201.

The backplane board 251 is mounted with the support boards 210 in that the overlapping recesses 252 of the board 251 and the taps 211 of the boards 210 are soldered together, thereby simultaneously providing afore mentioned electrical POE connections, i.e. four POE connections with each support insert 201. As can be clearly seen, the surface of the backplane board 251 on which the POE chips or IC chips 260 are mounted is forming an exterior surface of the inserts 200 and hence, at least such exterior surface is arranged outside the jack connector housings 100. As the operation of electric/electronic components, especially of the POE chips 260, forming part of the circuitry for providing and controlling power over LAN produces heat, the mounting of such electrical/electronic components integrated with the entire jack connector assembly outside the jack connector housings 100 is improving heat dissipation and hence, is effectively avoiding heat accumulation inside a connector housing 100.

Thus, in particular in case the backplane board 251 is equipped on both of its surfaces with assembly integrated electric/electronic components forming part of such a circuitry, the entire backplane board is positioned outside and remote from the connector housing 100. Moreover, since the distance of the support boards 210 between their front and rear sides may different with regard to different connector assemblies, in particular depending on the amount of components which have to be incorporated within the inserts 200, even the support boards 210 may only be partially insertable within the jack connector housings 100, as depicted.

The backplane board 251 further is provided with mounting means 253, such as bolts 253, with which additional close heat conducting elements can be mounted, such as by nuts 254, in particular to enlarge the heat conducting surface and hence, to further improve the overall heat dissipation to outside airflow. As an alternative however, the mounting means 253 and 254 can be made of suitable material, for example of a plastic material, for ensuring or increasing a hipot-isolation effect.

Such a preferred combination of heat conducting elements is shown in more detail in FIGS. 8 and 9 and includes a electrically isolating heat conductor unit 700 fixed close to the POE chips 260, the rear part 320 of the outer common shield fixed close to the heat conductor unit 700 and a heat sink 750 fixed close to the rear part 320 of the outer common shield.

With such an above described arrangement one heat sink 750 can be used for more then two POE chips 260.

The above described embodiment is further comprising a connection socket 265 for electrically and mechanically integrating the power connector 680 with the jack connector assembly.

By using one chip 260 per each port, in particular based on a address pin arrangement for providing the functionality of selectively addressing of each individual port, as described below, the chips 260 can be configured in more smaller dimensions and hence can be packaged more flexible. Moreover, by using one chip per each port, a such chip may be configured with a less complex inner structure.

Figure 11:
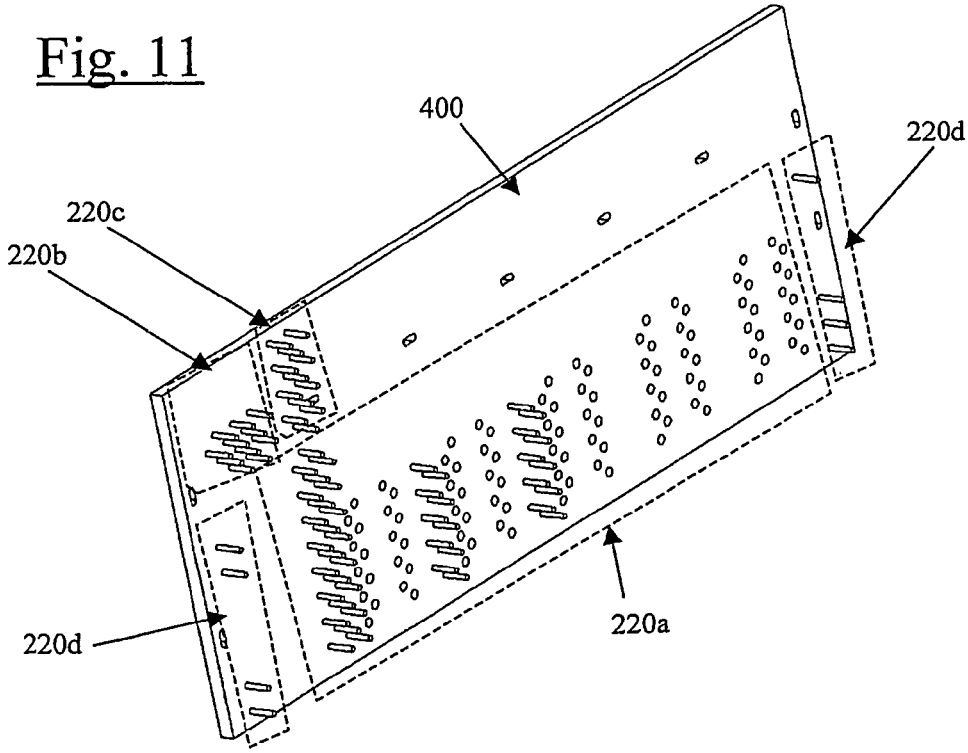
FIG. 11 is a more detailed view of the particular pin array arrangement of the embodiment of FIG. 10.

FIGS. 10 and 11 is showing a exemplary particular pin array arrangement of a preferred ground PCB 400 additionally having an increased function with regard to proving power supply pins 220 in case an additional power supply connector 680 is not integrated with the jack connector assembly.

As can be seen, the functionally increased ground PCB 400 is equipped with a plurality of pins 220 each of which arranged in a particular pin array 220*a*, 220*b*, 220*c* and 220*d* each of which is adapted to ensure a different functionality. For example, pin array 220*a* of PCB 400 is adapted as being an array for providing Ethernet pins, pin array 220*b* of PCB 400 is adapted as being an array for providing POE pins, pin array 220*c* of PCB 400 is adapted as being an array for providing LED pins. Pin array 220*d* of PCB 400 is adapted as being an array for providing power pins in case an additional power connector is not provided for connecting a power supplying cable.

However, based on a respective customer-layout request all of the pins 220 may be positioned even at a different position. In addition the positioning of further active and/or passive electrical/electronic components is possible to further enhance the functionality of the inventive connector assembly.

Figure 12:
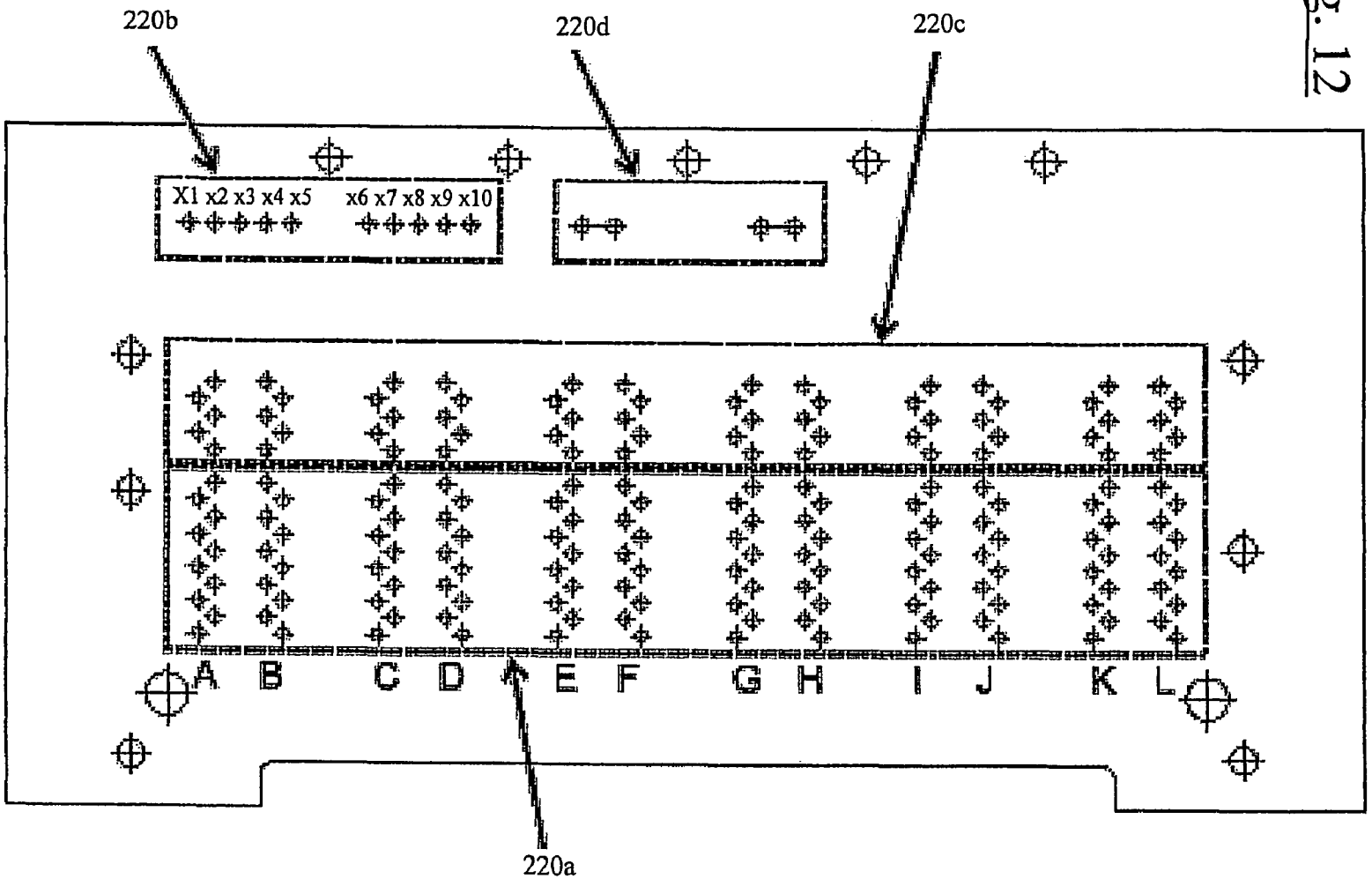
FIG. 12 is a further preferred embodiment of certain pin array arrangement incorporating pins ensuring addressing functions according to the invention.

FIG. 12 is showing a further exemplary certain pin area arrangement having a further increased function in particular with regard to additional address pins comprised by the area for proving POE pins 220*b*. Also the depicted arrangement is suitable for an inventive POE jack connector assembly having two rows of respective six ports according to FIG. 2 for example.

According to FIG. 12 a pin area 220*a* is adapted for providing Ethernet pin terminals ensuring the data interface to PHY (Physical media independent layer) devices, a pin area 220*c* is adapted for providing LED pin terminals for ensuring LED control, a pin area 220*d* is adapted for providing power supply pin terminals ensuring a power supply interface (48V) and a pin area 220*b* is adapted for providing POE pin terminals ensuring POE control via a bus, for example an $I^2C$ bus, and power (3.3V). The respective ports to be controlled are labelled on the board according to FIG. 12 with letters "A" to "L".

Regarding a preferred POE pin terminal area 220*b* based on FIG. 12 in more detail, in particular with regard to some characteristics, the POE pin terminals consist of signals for the $I^2C$ bus, 3.3 V, power-on reset (PO_RST) and mode select. These pin terminals are isolated with integrated optocouplers from the POE chips, 48 V supply and cable-side potential.

A preferred pin function assignment according to FIG. 12 may contain the following pin functionalities with regard to the pin area 220*b* pins labelled with x1 to X10.

| Pin# | PoE terminal | I/O | Descriptio |
|---|---|---|---|
| X1 | MS | I | Mode Select; Configuring this pin high causes the PoE jack connector assembly to work in Auto Mode. Configuring this pin low causes the PoE jack connector assembly to work in Power Management Mode. Preferably, this pin should be configured at start-up and not modified during normal operation. |

-continued

| Pin# | PoE terminal | I/O | Descriptio |
|---|---|---|---|
| X2 | SDA_OUT | O | $I^2C$ Data Out; Data will be supplied by this pin when the $I^2C$ bus is read mode. The SDA_IN and the SDA_OUT pins can be connected together to create a complete 2-wire $I^2C$ bus. |
| X3 | SDA_IN | I | $I^2C$ Data In; Data can be applied to the $I^2C$ bus in accordance with the $I^2C$ clock provided. |
| X4 | SCL_IN | I | $I^2C$ clock; An $I^2C$ clock can be applied to this pin with frequency from 0 kHz to 400 kHz. |
| X5 | GND | I | Digital GND; The GND of the 3.3 V supply can be applied to this pin. |
| X6 | D3.3V | I | Digital 3.3 V External; The 3.3 V supply can be applied to this pin. This pin is internally connected to the LED anodes. |
| X7 | PO_RST | I | Power On Reset (active low); When pulled low, this pin holds the PoE jack connector assembly in the reset state. Once PO_RST is pulled high, the $I^2C$ interface will become active and the PoE jack connector assembly will become fully operational. |
| X8 | INTB | O | Interrupt line (active low); When this pin goes low, a fault has occurred on one of the ports. The $I^2C$ is used to read the port read registers to determine which port. |
| X9 | ADR4 | I | Hardwired to GND or D3.3 to set jack connector assembly address A4. |
| X10 | ADR5 | I | Hardwired to GND or D3.3 to set jack connector assembly address A5. |

With regard to the $I^2C$ address pins, bits A1 to A3 of the $I^2C$ address of each POE module or jack connector assembly may be internally hardware. The external address pins could be used to set bit A4 to A5 individually for different POE modules or connector assemblies packaged together on a same board for example. With such configuration it is possible to control for example up to four POE connector assemblies by a single $I^2C$ interface.

The $I^2C$ interface may be set for group broadcast on address 0 allowing simultaneous access to an entire bank of POE connector assemblies. Per-port write registers control and manipulate the flow of the discovery, classification and power-up states during part management mode; while the read registers contain status information of the entire process along with parametric values of discovery, classification and real time port operating current voltage and die temperature.

For the $I^2C$ addressing a host processor or micro controller e.g. is provided for getting access to the POE connector or module through an $I^{2C}$ bus. This bus provides access to device registers within the chip.

A serial interface preferably used in a PoE module or connector assembly can be used as either a standard 2-wire or 3-wire $I^2C$ bus. The standard bi-directional SDA lines of the $I^2C$ bus then have been broken out into independent input and output data paths. The bi-directional property of the SDA line can be restored by connecting SDA_I to SDA_O.

The SCL line is always an input to the modules, which always act as slave devices.

Data transfers that require a data-flow reversal on the SDA line are 4-byte operations. This would occur during a module port read access cycle where a slave address byte is sent, followed by a Port/register address byte write. A second slave address byte is sent followed by the data byte read using the port/register addresses from the second byte in the sequence.

Data write transfers to the module or connector assembly consist of a 3-byte operation. The sequence in this case would be to send a slave address byte, followed by a write of the port/register address followed by a write of the data byte for the addressed port.

Accordingly an $I^2C$ access cycle may comprise the following steps including

Start Sequence (S), Slave address field, Read/Write, Acknowledge, Port address or data field, Acknowledge/Not Acknowledge and Stop Sequence (P), wherein the $I^2C$ interface and the port read/write registers are held in active reset until input voltage is within specification and the internal POR timer has timed out.

The PoE module internally hardwires device address bits A1 to A3 for each integrated PSE (Power source equipment) device. The bits A4 and A5 are connected to external address pins ADR4 and ADR5. With those external address pins the IC-chip addresses can be defined individually for each of up to four modules connected to the same $I^2C$ bus. These bits are compared against the hard-wired state of the corresponding port address select pins. Ports are selected four at a time (per chip). When the field contents are equivalent to the pin logic states, the corresponding four ports are addressed. These bits are followed by LSB bit, which is used to set the read or write condition (1 for read and 0 for write). Following a start condition and an address field, the PoE module will respond with an acknowledge by pulling the SDA line low during the 9th clock cycle if the address field is correspondingly. The SDA line will remain a stable low while the 9th clock pulse is high.

Thus, the $I^2C$ address can be used for register accesses for particular ports with each of selectively addressable chips being usable for respective up to four POE ports according to the embodiments depicted in the drawings.

However, as an alternative for each port a separate chip may be provided as already discussed above.

Thus, by means of address pins, each individual port may be selectively operated with remote power supply managements via a single $I^2C$ bus. Moreover by providing a hipot insulation preferably by the use of optocouplers within the inventive modular POE connector assembly or module with regard to the address pins and the $I^2C$ bus, at a customer board is no further need to add similar hipot insulation means for providing the hipot requirements necessary therefore.

Attention is invited to the functionally increasable PCB 400 itself. Based on one pre-given food-print-layout, i.e. the mechanical design of a basic ground PCB 400 adapted to be used with a basic design of an inventive jack connector assembly, instead of the basic PCB 400 a PCB 400 is used having a customer based increasable functionality, especially by using press-fit approaches and/or pin-in-hole-reflow-solder approaches in connection with the basic design. Some of the pins 220 are passed only via clearance holes, some other pins 220 are connected with the PCB 400 and directed to an other position via the particular routing and/or wiring of the PCB 400 such that an optimised functionality based on the customer request is provided. Accordingly, the customer receives with an optimised routing and/or wiring even an enhanced performance.

One further advantaged thereof is for example, that even the power supply over particular pins 220 may be ensured, in particular based on router-boards of a customer or Ethernet provider without a power cable connector. Moreover, the routing concept of the customer may be simplified by the arrangement of the pins 220 in individual "functionality-sectors" or pin arrays and hence, the routing itself is simplified for the customer.

Thus the inventive integration is saving space and a lot of costs because of the reduction of components and of the layer quantity on the customer or network provider side. Also less logistic for less components on a customer PCB is necessary. Moreover, the shorter traces causes better electromagnetic interference (EMI) results and less components provide more space for other new add-ons.

REFERENCE SIGNS

100 jack connector housing,
110, 111 plug receiving openings,
112 rear side of jack connector housing,
118 mounting ribs
115 fastenings means
180 guide way
200 insert
201 support insert of insert
210 support plates or board
211 tap for mounting the backplane board
220 pins
220*a,b,c,d* pin arrays
221 short pin end
230 chicklett
231, 232 chicklett halves
233 mounting means for solenoid
240 row of electrical contacts
241 rear end of contact
243*a,b* complementary snap means
244*a,b* complementary snap means
245, 246 contact section
247 bent area
248 LED
249 light pipe
251 backplane board integrated with insert
252 recesses
253 mounting means
254 nut
260 IC-chip
265 connection socket
270 shielding plat of chicklett
271 solder area
272 bent tap
280 solenoid box
315 front part of common outer shield,
301, 312 plug recesses
314 shielding taps
319 projection sections
320 rear part of common outer shield,
321 solder taps
322 cut-out sections
330 cut-out
370 solder extensions
400 ground shield board
410 holes
650 customer or support board
680 power connector
690 power connector plug

The invention claimed is:

1. A modular jack connector assembly comprising:

at least one connector housing and at least one connector insert insertable into the connector housing;

each connector housing comprising a front mating side with at least one port opening for receiving a plug having a plurality of electrical contacts and a rear-side for inserting at least one of said connector inserts; and each connector insert comprising a front-end side and a rear-end side and supporting electrical contacts with contact sections arranged at the front end for detachable connection with corresponding electrical contacts of at least one of said plugs and supporting on the rear-end side components of a circuitry providing a power-over-local area network (LAN) functionality;

wherein the components are configured to provide the power over LAN-functionality for at least one port; wherein the modular jack further includes a common outer shield with a rear portion, and a conductor plate that is positioned between the components providing the power-over-LAN functionality and the rear portion, wherein thermal energy is transferred from the circuitry to the common shield via the conductor plate.

2. The connector assembly of claim 1, wherein the components of a circuitry providing a power over LAN-functionality are arranged outside the jack connector housing.

3. The connector assembly of claim 1, wherein said circuitry components are mounted to a backplane board connected to the rear-end side of at least one support insert, said backplane board and the at least one support insert forming at least one insert which is received by at least one connector housing with the front-end side of the at least one support insert first and with at least said circuitry components being arranged outside the housing.

4. A connector assembly of a local area network that includes at least one local area network node, the connector assembly comprising:

at least one connector housing; a first plurality of first electrical contacts mounted in the housing and arranged for detachable connection with corresponding electrical contacts of at least one plug insertable into a respective port opening provided by the housing;

a second plurality of second electrical contacts arranged for connection with corresponding electrical contact of LAN equipment; and active power control circuitry components coupled to at least some of the first and second electrical contacts, the active power control circuitry components being operative for controlling the supply of electrical power over cabling of the LAN to the at least one node of the LAN, the active power control circuitry components being located outside the at least one connector housing;

wherein the circuitry components are mounted to a backplane board connected to the rear-end side of at least one support insert, the backplane board and the at least one support insert forming at least one insert which is received by at least one connector housing with the front-end side of the at least one support insert first and with at least the circuitry components being arranged outside, wherein at least some of the circuitry components are mounted at a backplane board surface defining an exterior surface of the insert and the circuitry components are positioned adjacent a shield, wherein a conductor plate is compressed between the shield and the circuitry components.

5. The connector assembly of claim 4, wherein the conductor plate comprises a heat conducting and electrically isolating material.

6. The connector assembly of claim 4, wherein each support insert comprises two support boards spaced apart from each other and defining together with the backplane board exterior side and rear surfaces of a respective insert.

7. The connector assembly of claim 6, wherein each support board and the backplane board is provided with at least one of a wiring circuit and a routing circuit.

8. The connector assembly of claim 6, wherein each support board and the backplane board comprise respectively complementary formed mounting means.

9. The connector assembly of claim 6, wherein each support board comprises at its rear-end side at least one tap overlapping with a respectively complementary formed recess soldered together, thereby providing at least one electrical connection.

10. The connector assembly of claim 9, wherein for each port opening a power-over-LAN connection is provided.

11. The connector assembly of claim 6, further comprising LEDs supported by the support inserts and arranged to emit light in direction to the port openings.

12. The connector assembly of claim 11, wherein for each port at least one LED is provided, the LED being electrically connected by means of a ground board of the assembly, the ground board having a definable routing layout.

13. The connector assembly of claim 4 wherein a power connector is integrated with the assembly by an electrical and mechanical connection with the backplane board for receiving a power supply via an insertable power connector plug.

14. The connector assembly of claim 4 wherein a power supply is provided over power pins electrically connected via a ground board having a definable routing layout.

15. The connector assembly of claim 4, having a ground board having a definable routing layout with particular pin arrays respectively adapted for at least one of providing and receiving terminal pins enabling individual functions.

16. The connector assembly of claim 15, wherein the pin arrays are at least split in arrays enabling at least one of a power-over-LAN pin functionality, a LED pin functionality, and a LAN pin functionality.

17. The connector assembly of claim 15, wherein the pin arrays comprise address pins.

18. The connector assembly of claim 17, wherein addressing means is incorporated that comprises address pins.

19. The connector assembly of claim 17, wherein the address pins are connected for addressing purposes of the connector from the outside.

20. The connector assembly of claim 19, wherein the control of the address pins is supported by at least one bus.

21. The connector assembly of claim 20, wherein the connector is provided with a hipot insulation for the address pins and the bus.

22. The connector assembly of claim 21, wherein the hipot insulation comprises the use of at least one a component providing galvanic isolation.

23. The connector assembly of claim 15 wherein the arrays comprise at least one array providing a power supply pin functionality.

24. The connector assembly of claim 4, wherein at least some of the circuitry components comprise at least one IC-chip controlling power supply and power management for providing the power-over-LAN functionality.

25. The connector assembly of claim 24, comprising for each port a respective such IC-chip.

26. The connector assembly of claim 4, with the assembly being Ethernet compatible.

* * * * *